US007646342B2

(12) United States Patent
Huang et al.

(10) Patent No.: US 7,646,342 B2
(45) Date of Patent: Jan. 12, 2010

(54) ANTENNA

(75) Inventors: Jiunn-Ming Huang, Taipei (TW); Shen-Pin Wei, Taipei (TW); Yuan-Li Chang, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 101 days.

(21) Appl. No.: 11/769,638

(22) Filed: Jun. 27, 2007

(65) Prior Publication Data

US 2008/0100512 A1 May 1, 2008

(30) Foreign Application Priority Data

Oct. 31, 2006 (TW) ..... 95140196 A

(51) Int. Cl.
*H01Q 1/38* (2006.01)
*H01Q 1/24* (2006.01)

(52) U.S. Cl. ..... 343/700 MS; 343/702; 343/846

(58) Field of Classification Search ..... 343/702, 343/700 MS, 846
See application file for complete search history.

(56) References Cited

U.S. PATENT DOCUMENTS 6,147,652 A 11/2000 Sekine
6,166,694 A * 12/2000 Ying ..... 343/702
6,353,443 B1 * 3/2002 Ying ..... 715/702
6,812,892 B2 * 11/2004 Tai et al. ..... 343/700 MS
6,891,504 B2 5/2005 Cheng et al.
6,930,641 B2 * 8/2005 Ohara et al. ..... 343/702
7,034,754 B2 * 4/2006 Hung et al. ..... 343/700 MS
7,242,353 B2 * 7/2007 Hung et al. ..... 343/702
7,298,334 B2 * 11/2007 Fang et al. ..... 343/700 MS
2005/0073462 A1 * 4/2005 Lin et al. ..... 343/702
2007/0040754 A1 * 2/2007 Liu et al. ..... 343/702

FOREIGN PATENT DOCUMENTS

TW 1227576 2/2005

* cited by examiner

*Primary Examiner*—Hoang V Nguyen
(74) *Attorney, Agent, or Firm*—Quintero Law Office

(57) ABSTRACT

An antenna comprises a first transmission element, a second transmission element, a conductive element, a ground element, a ground line and a signal line. The conductive element is connected to the ground element. The first transmission element is connected to the conductive element. The first transmission element comprises a first spiral structure and a first axis. The second transmission element is connected to the conductive element. The ground line is electrically connected to the ground element. The signal line is electrically connected to the conductive element at a feed point.

7 Claims, 10 Drawing Sheets

ANTENNA

BACKGROUND OF THE INVENTION

1. Field of the Invention

The invention relates to an antenna, and more particularly to an inverse F antenna comprising spiral structure.

2. Description of the Related Art

FIG. 1 shows a conventional antenna 10 comprising a ground element 1, a conductive element 2, a transmission element 3, and a coaxial cable 4. The conductive element 2 is connected to the ground element 1. The transmission element 3 is connected to the conductive element 2. The coaxial cable 4 is electrically connected to the ground element 1 and the conductive element 2.

Conventionally, the length of the transmission element 3 is determined according to the wavelength of the wireless signal transmitted by the antenna 1. The length of the transmission element 3 thus cannot be reduced. As well, the conventional antenna 10 requires additional a matching element to modify impedance thereof, and volume of the antenna 10 is increased.

BRIEF SUMMARY OF THE INVENTION

A detailed description is given in the following embodiments with reference to the accompanying drawings.

The invention provides an antenna comprising a first transmission element, a second transmission element, a conductive element, a ground element, a ground line and a signal line. The conductive element is connected to the ground element. The first transmission element is connected to the conductive element. The first transmission element comprises a first spiral structure and a first axis. The second transmission element is connected to the conductive element. The ground line is electrically connected to the ground element. The signal line is electrically connected to the conductive element at a feed point.

The embodiment provides an antenna of reduced size and improved transmission.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
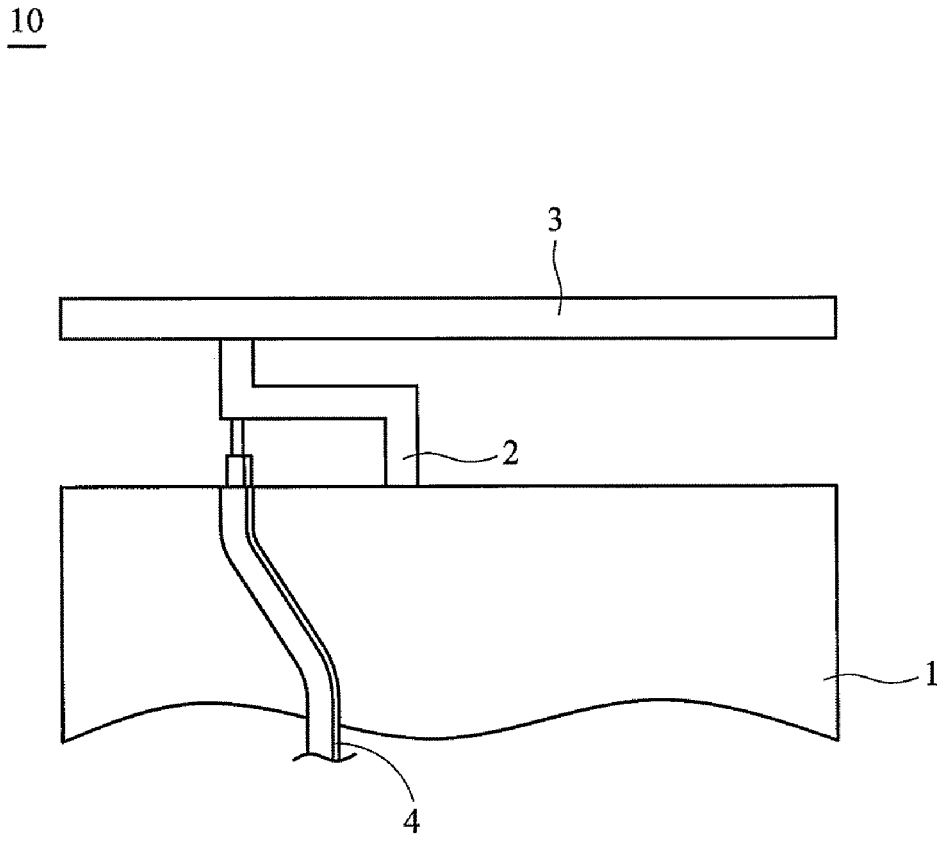
FIG. 1 ( PRIOR ART )
FIG. 1 shows a conventional antenna.
Figure 2A:
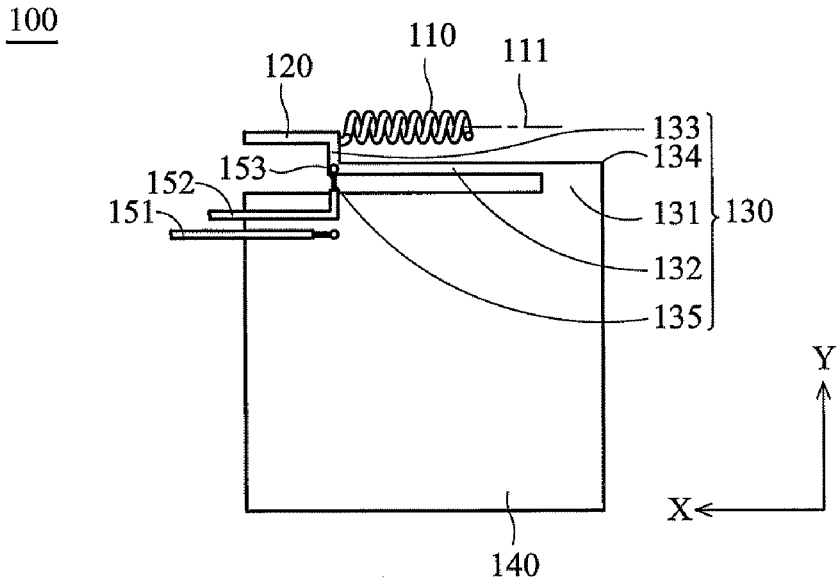
FIGS. 2*a* and 2*b* show an antenna of a first embodiment.
Figure 2B:
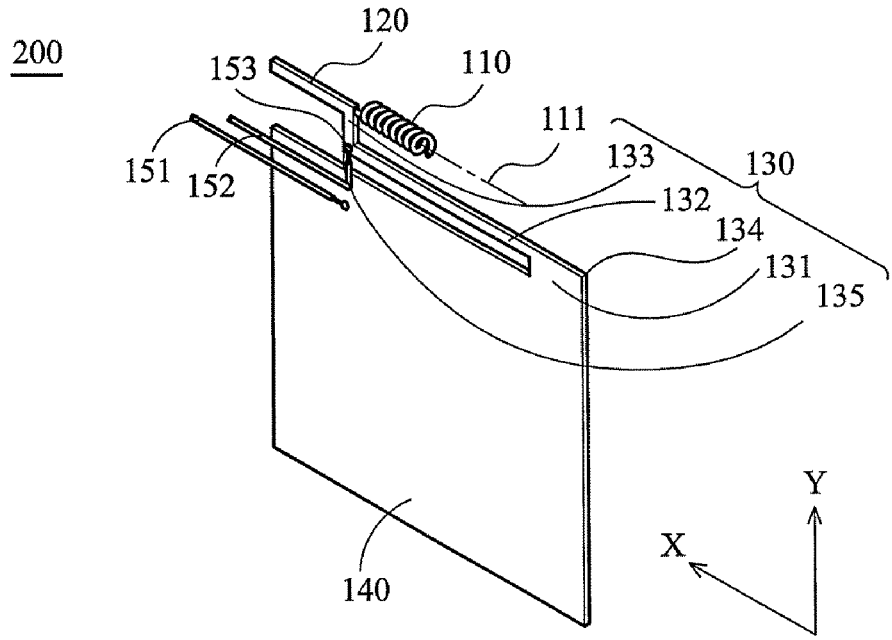

FIGS. 2*a* and 2*b* show an antenna 100 of a first embodiment, which is an inverse F antenna. The antenna 100 comprises a first transmission element 110, a second transmission element 120, a conductive element 130, a ground element 140, a ground line 151, and a signal line 152. The conductive element 130 comprises a first section 131, a second section 132, a third section 133, a first angled portion 134 and a second angled portion 135. The first section 131 is connected to the ground element 140. The first angled portion 134 connects the second section 132 and the first section 131. The second angled portion 135 connects the third section 133 and the second section 132. The first section 131 and the third section 133 extend in a first direction Y. The second section 132 extends in a second direction X. The first direction Y is perpendicular to the second direction X. The first transmission element 110 is connected to the third portion 133 comprising a first spiral structure and a first axis 111. The first axis 111 extends in a third direction −X. The second transmission element 120 is connected to the third section 133. The second transmission element 120 extends in the second direction X. The ground line 151 is electrically connected to the ground element 140. The signal line 152 is electrically connected to the conductive element 130 on a feed point 153. In the first embodiment, the feed point 153 is located on the second angled portion 135 between the second section 132 and the third section 133. However, the feed point 153 can be located elsewhere on the second section 132 or the third section 133.

The first transmission element 110 comprises a first spiral structure to decrease the length of the first transmission element 110 and the size of the antenna 100.

Figure 3A:
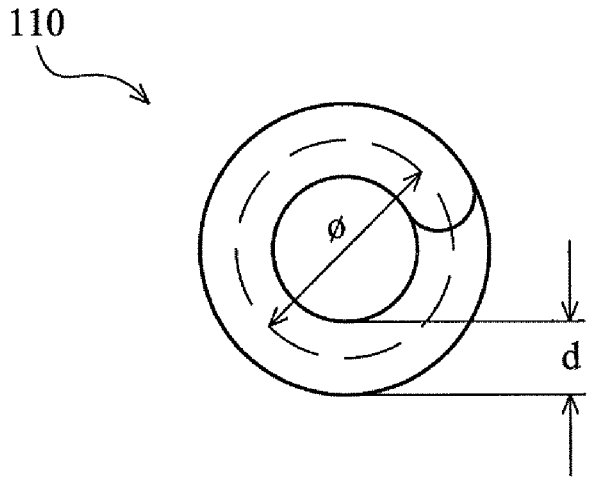
FIG. 3*a* is a front view of a first transmission element.
Figure 3B:
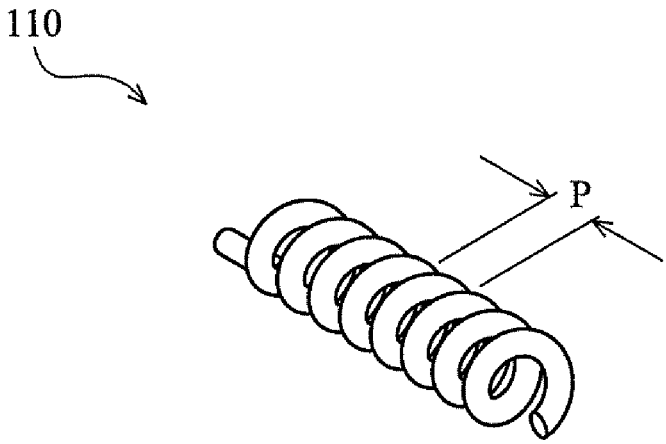
FIG. 3*b* is a perspective view of a first transmission element.

FIG. 3 is a front view of the first transmission element 110, and FIG. 3*b* is a perspective view of the first transmission element 110. The first spiral structure of the first transmission element 110 comprises a wire diameter d, a thread diameter $\phi$, a thread pitch P and a thread number $N_1$ (not shown). The impedance matching of the antenna 100 can be modified by changing the wire diameter d, the thread diameter $\phi$, the thread pitch P and the thread number $N_1$. Additionally, the bandwidth of the first transmission element 110 can be modified via changing the wire diameter d.

Figure 4:
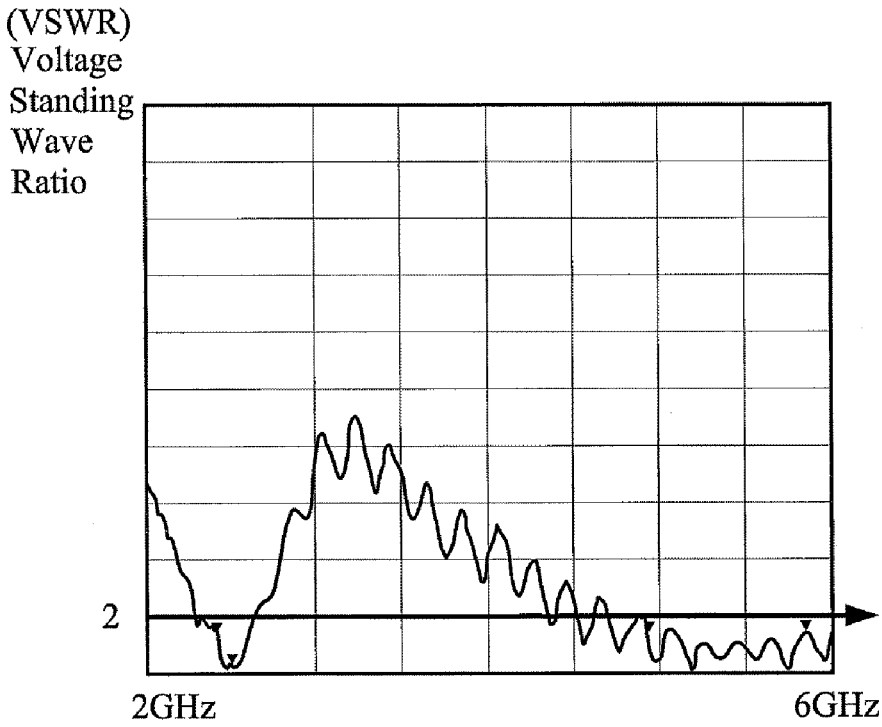
FIG. 4 shows the transmission of a first embodiment.

In the first embodiment, the wire diameter d is 0.5 mm, the thread diameter $\phi$ is 2 mm, the thread pitch P is 1 mm, and the thread number $N_1$ is 8. FIG. 4 shows the transmission of the antenna 100 of the first embodiment. The antenna 100 has Voltage Standing Wave Ratio (VSWR) lower than 2 in bandwidths 2.4-2.5 GHz and 4.9-5.83 GHz. The embodiment thus provides an antenna of reduced size and improved transmission.

Figure 5A:
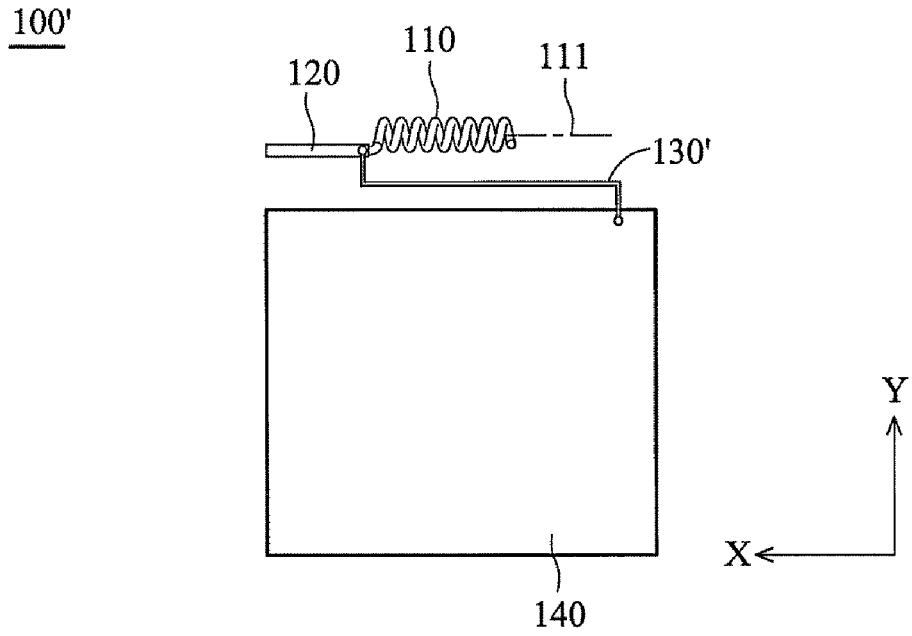
FIGS. 5*a* and 5*b* show a modified example of the first embodiment.
Figure 5B:
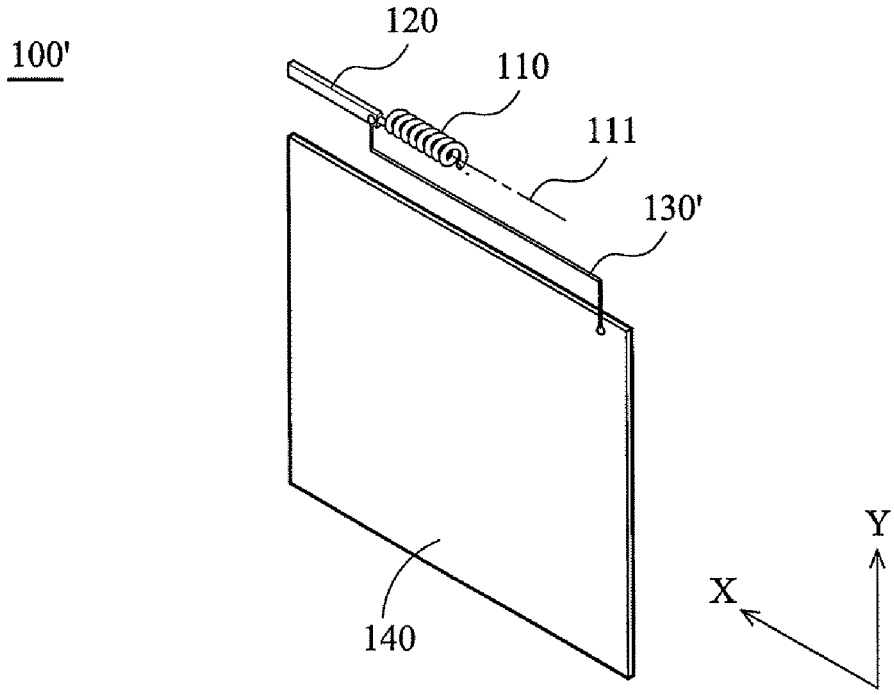

The ground element 140 is metal sheet or foil, for example, copper sheet or copper foil. The conductive element 130 is metal sheet or metal line. FIGS. 5*a* and 5*b* shows an antenna 100' of a modified example, wherein the conductive element 130' is a copper line. In another modified embodiment, the ground element and the conductive element are formed on a circuit board.

Figure 6A:
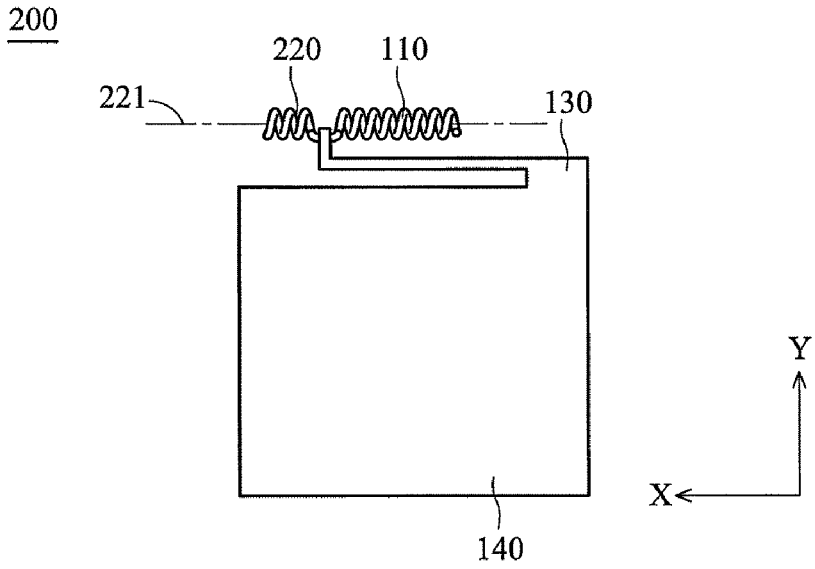
FIGS. 6*a* and 6*b* show an antenna of a second embodiment.
Figure 6B:
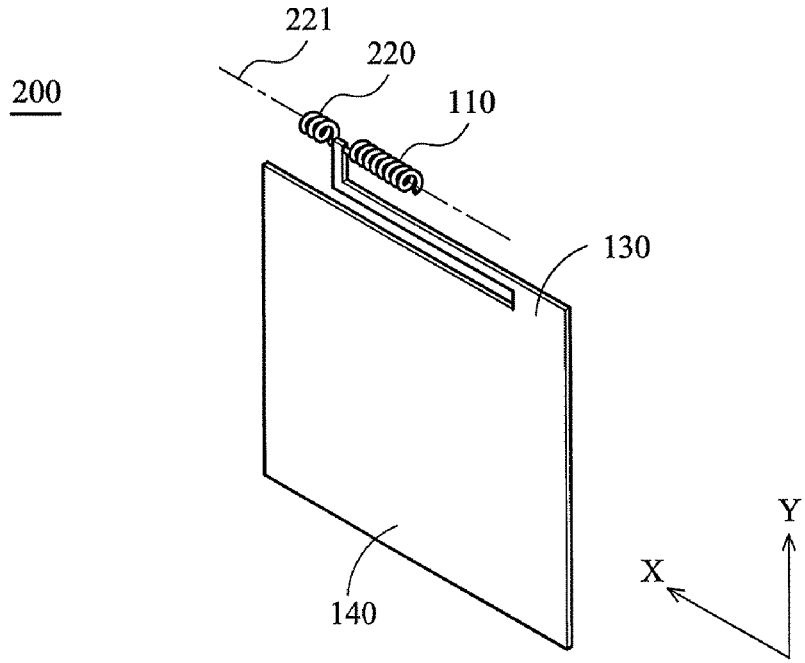

FIGS. 6*a* and 6*b* show an antenna 200 of a second embodiment, wherein the second transmission element 220 comprises a second spiral structure and a second axis 221. The wire diameter d of the second spiral structure is 0.5 mm, the thread diameter $\phi$ is 2 mm, the thread pitch P is 1 mm, and the thread number $N_2$ is 2.5. The second axis 221 extends in the second direction X.

Figure 7A:
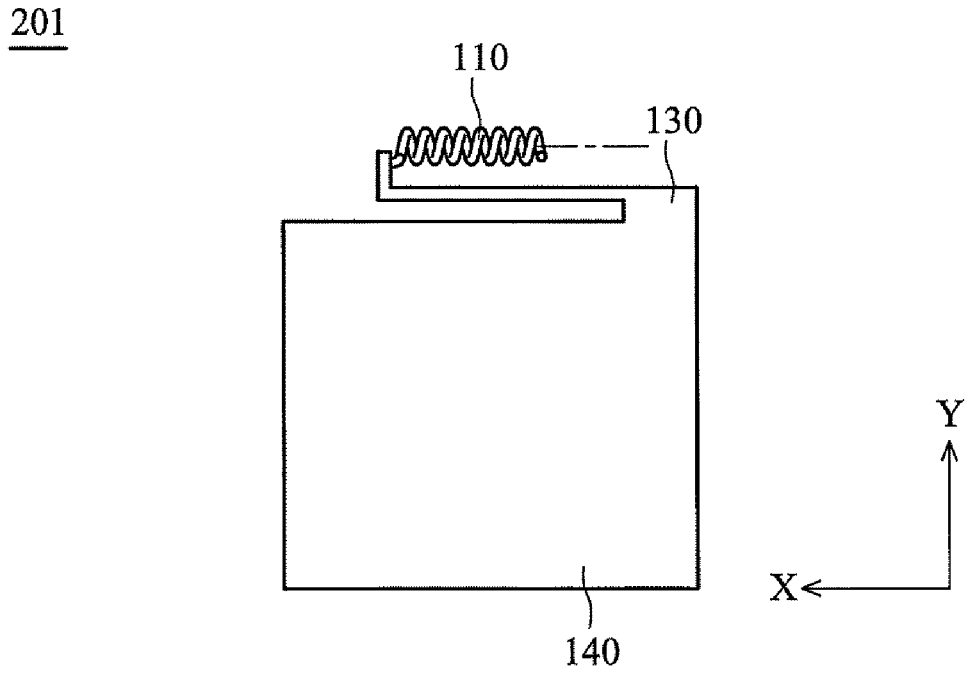
FIG. 7*a* shows a modified embodiment of the invention.

FIG. 7*a* shows an antenna 201 of a modified embodiment, wherefrom the second transmission element is omitted, and the antenna 201 transmits wireless signal via the first transmission element 110.

Figure 7B:
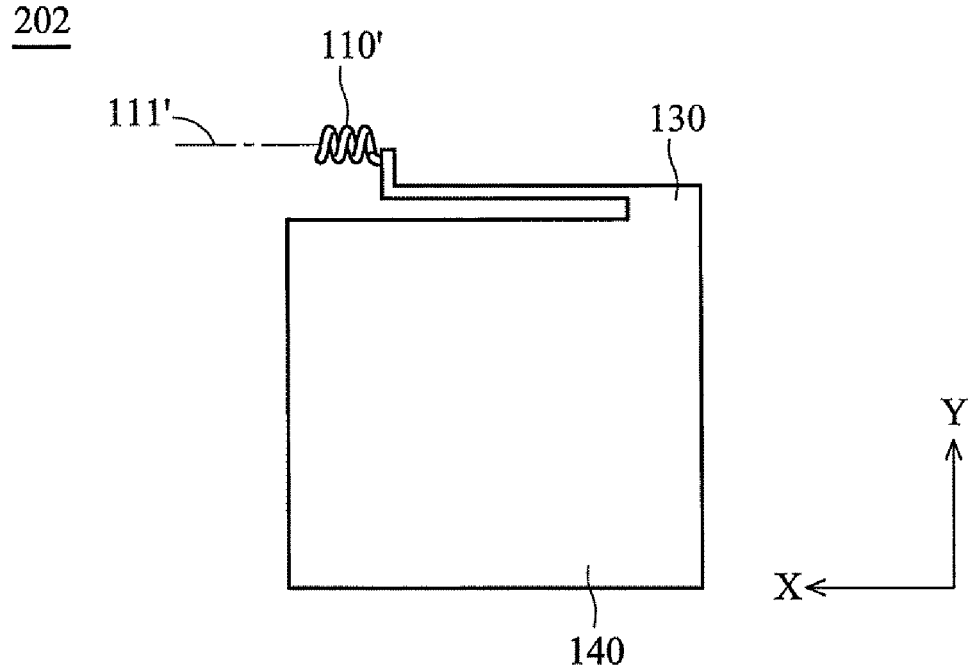
FIG. 7*b* shows another modified embodiment of the invention.

FIG. 7*b* shows an antenna 202 of another modified embodiment, wherein the first transmission element 110' comprises a first axis 111' extending in the second direction X.

Figure 7C:
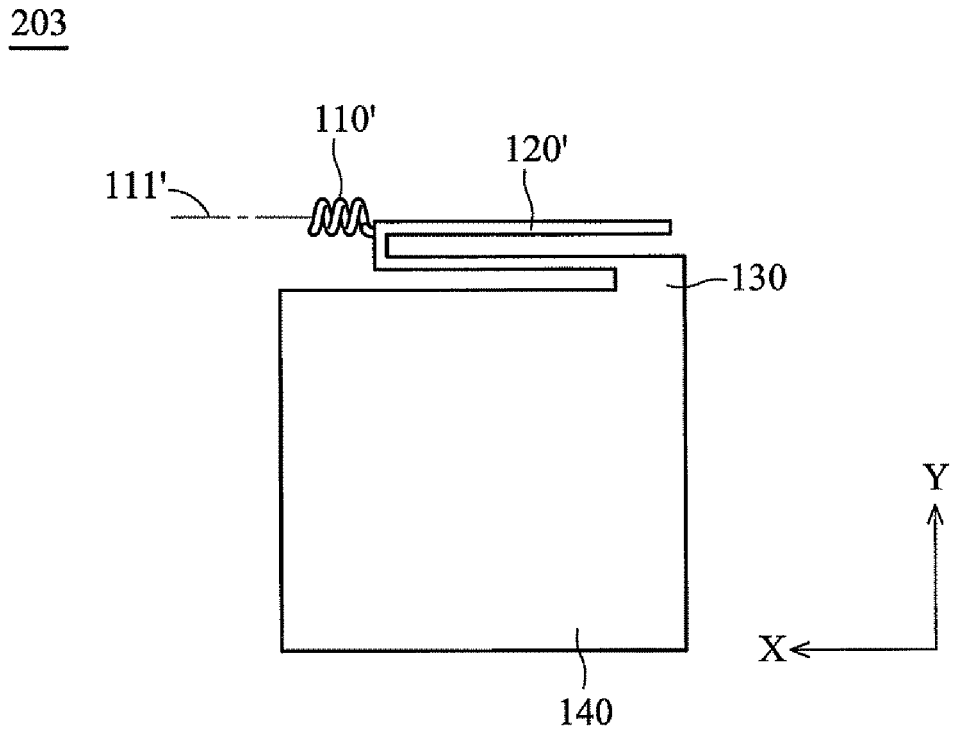
FIG. 7*c* shows another modified embodiment of the invention.

FIG. 7*c* shows an antenna 203 of another modified embodiment, wherein the second transmission element 120' is connected to the transmission element 130 extending in the third direction −X.

Figure 8A:
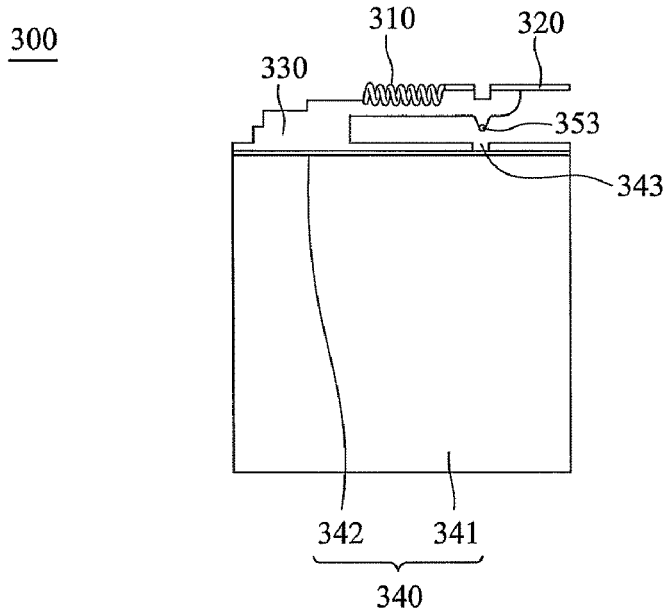
FIGS. 8*a* and 8*b* show an antenna of a third embodiment.
Figure 8B:
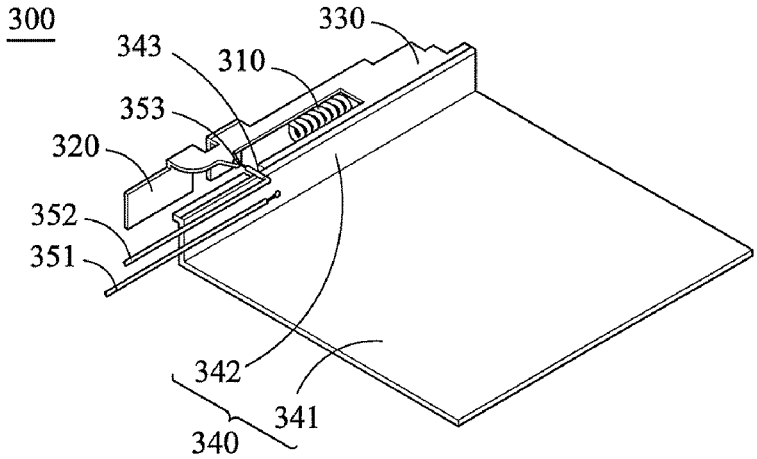

FIGS. 8*a* and 8*b* show an antenna 300 of a third embodiment comprising a first transmission element 310, a second transmission element 320, a conductive element 330, a ground element 340, a ground line 351 and a signal line 352. The first transmission element 310 is connected to the conductive element 330. The first transmission element 310 comprises a first spiral structure. The second transmission element 320 is connected to the conductive element 330. The ground line 350 is electrically connected to the ground element 340. The signal line 352 is electrically connected to the conductive element 330 on a feed point 353. The ground element 340 comprises a body 341 and a third angel portion 342. The third angled portion 342 is perpendicular to the body 341. The conductive element 330 is connected to the third angled portion 342. The conductive element 330 is parallel to the body 341. The second transmission element 320 is parallel to the third angled portion 342. The signal line 352 is connected to the feed point 353 passing an opening 343 of the third angled portion 342.

Figure 9:
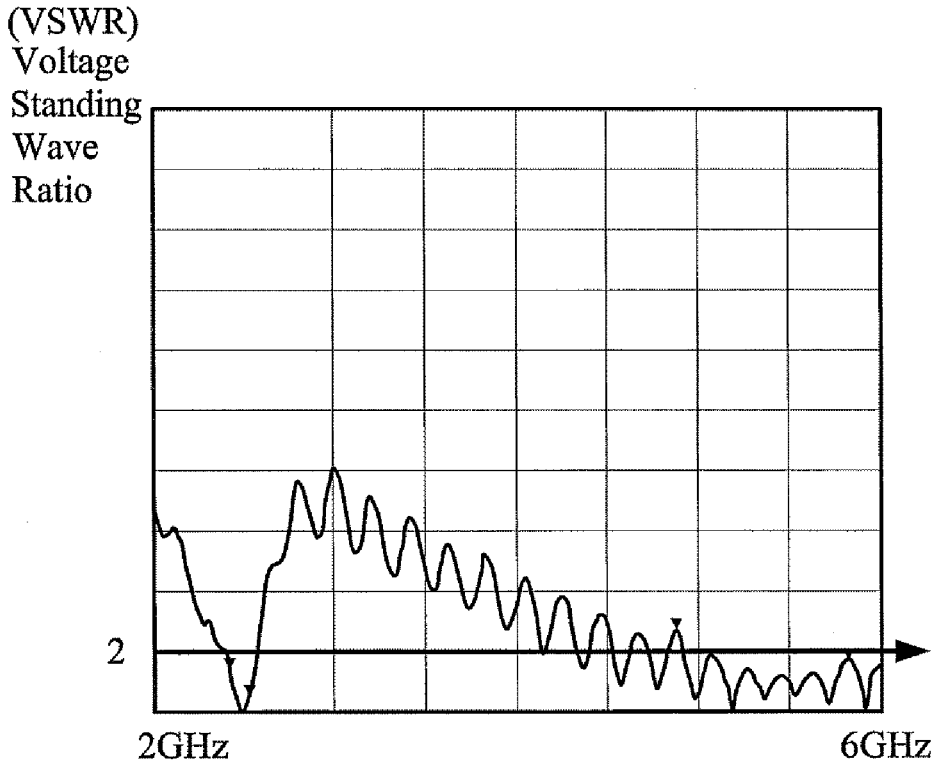
FIG. 9 shows the transmission of the third embodiment.

In the third embodiment, the wire diameter d is 0.8 mm, the thread diameter $\phi$ is 3 mm, the thread pitch P is 1.8 mm, and the thread number $N_3$ is 7. FIG. 9 shows the transmission of the antenna 300 of the third embodiment. The antenna 300 has Voltage Standing Wave Ratio (VSWR) lower than 2 in bandwidths 2.4-2.5 GHz and 4.9-5.83 GHz. The embodiment thus provides an antenna of reduced size and improved transmission.

In the embodiments, the antennas are inverse F antennas. However, the invention is not limited thereto. The spiral structure of the invention can be utilized in other antennas.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a ground element, wherein the ground element comprises a body and a third angled portion connected to and perpendicular to the body;

a conductive element, connected to the third angled portion, and parallel to the body;

a first transmission element, connected to the conductive element, wherein the first transmission element comprises a first spiral structure; and a second transmission element, connected to the conductive element, wherein the second transmission element is parallel to the third angled portion.

2. The antenna as claimed in claim 1, further comprising a ground line, wherein the ground line is electrically connected to the ground element.

3. The antenna as claimed in claim 2, further comprising a signal line, wherein the signal line is electrically connected to the conductive element on a feed point.

4. The antenna as claimed in claim 3, wherein a notch is formed on an edge of the third angled portion, and the signal line extends through the notch to the feed point.

5. The antenna as claimed in claim 3, wherein the feed point is located on an edge of the conductive element.

6. The antenna as claimed in claim 5, wherein the feed point is located on a base line, the base line located between the first transmission element and the second transmission element, and the base line is perpendicular to the third angled portion.

7. The antenna as claimed in claim 1, wherein the first transmission element extends in a first direction, the second transmission element extends in a second direction, and the first direction is opposite to the second direction.

* * * * *